US005210981A

United States Patent [19]

Urda

[11] Patent Number: 5,210,981

[45] Date of Patent: May 18, 1993

[54] BELT SANDER MOUNTING BLOCK AND GUARD ASSEMBLY

[75] Inventor: Paul Urda, South Waverly, Pa.

[73] Assignee: Ingersoll-Rand Company, Woodcliff Lake, N.J.

[21] Appl. No.: 829,824

[22] Filed: Feb. 3, 1992

[51] Int. Cl.[5] ..... B24B 23/06

[52] U.S. Cl. ..... 51/170 EB; 51/135 R

[58] Field of Search ..... 51/170 EB, 170 R, 166 R, 51/135 R, 135 BT, 141

[56] References Cited

U.S. PATENT DOCUMENTS

| | | | |
|---|---|---|---|
| 3,619,949 | 11/1971 | Welsch et al. | 51/135 BT X |
| 3,643,385 | 2/1972 | Mikiya | 51/170 EB |
| 3,713,255 | 1/1973 | Welsch | 51/135 X |
| 4,368,597 | 1/1983 | Fleckenstein | 51/170 EB |
| 4,578,906 | 4/1986 | Appleton | 51/170 EB |
| 5,031,362 | 7/1991 | Reiling et al. | 51/170 EB |

*Primary Examiner*—Bruce M. Kisliuk
*Assistant Examiner*—John A. Marlott
*Attorney, Agent, or Firm*—Walter C. Vliet

[57] ABSTRACT

A two-piece belt sander mounting block and guard assembly is provided which permits the mounting of the belt sanding attachment to a handheld power tool. The guard is separate from the mounting block and is attached thereto permitting variations in materials and guard design to effect economies in materials and manufacture while improving the respective functions of the mounting block and the guard by both material selection and design function.

6 Claims, 2 Drawing Sheets

BELT SANDER MOUNTING BLOCK AND GUARD ASSEMBLY

BACKGROUND OF THE INVENTION

This invention relates generally to sanding belt tensioning devices and more particularly to a mounting block and guard device for a mini belt sander attachment for a handheld power tool.

In similar prior art devices the design of the mounting block and guard required that the device be constructed from a cast or machined part which cooperated with the tool housing. The resulting device was expensive to manufacture and added excessive weight. Since the function of a mounting block and a guard are different, the prior design did not allow for selection of optimum materials to perform the function. The assembly required close machined tolerances for adequate performance.

The foregoing illustrates limitations known to exist in present mini belt sander art. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention this is accomplished by providing a belt sander mounting block and attached guard device for a belt sander or the like comprising a mounting block means for mounting a belt sanding device to a rotary power source; a sanding belt engaging and driving means operatively connected to the rotary power source for rotation about a driven axis; and a guard means attached to the mounting means and at least partially encircling the engaging and driving means about the driven axis for limiting contact with the engaging and driving means.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
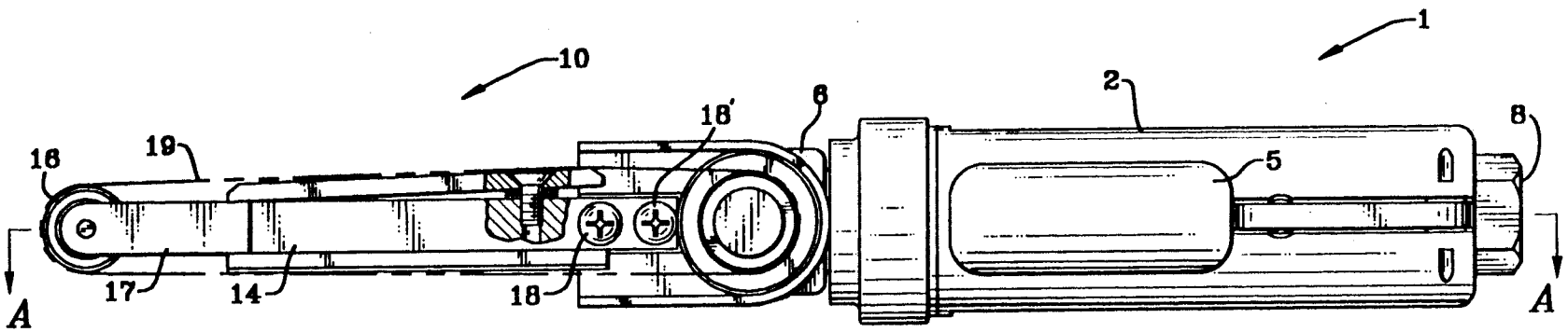
FIG. 1 (PRIOR ART)
FIG. 1 is a side view illustrating a mini belt sander adapted to a handheld power tool generally according to the prior art.

Referring to FIG. 1 a mini belt sander for attachment to a handheld power tool according to the prior art is shown generally by reference numeral 1. The power tool comprises a motor housing 2 connected to an angle drive 6 to which is mounted a belt sanding device generally indicated by reference numeral 10.

Figure 2:
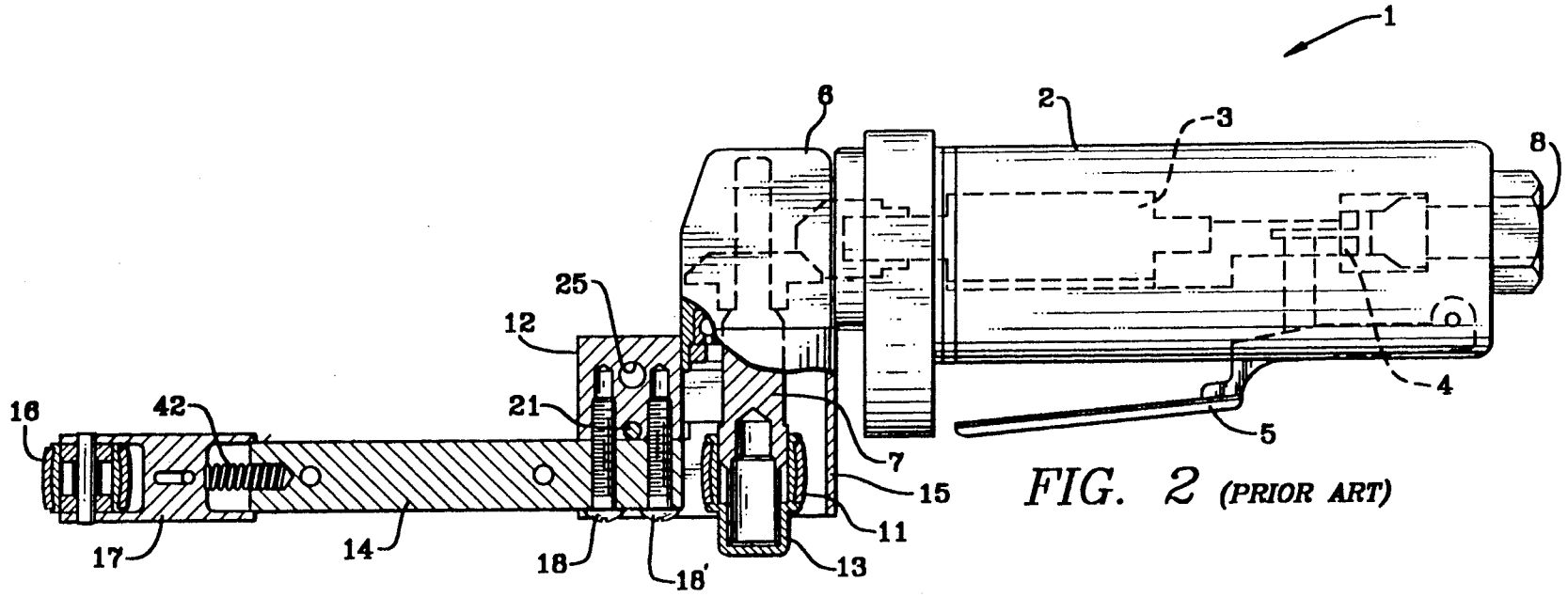
FIG. 2 (PRIOR ART)
FIG. 2 is a plan cross sectional view of the mini handheld sander according to the prior art taken about section A—A of FIG. 1.

As best seen in FIG. 2, a pneumatic driven handheld power tool receives pressure fluid through an air inlet 8 which passes the pressure fluid to a valve assembly 4 operated by a throttle lever 5. Air passing through the valve assembly is admitted to an air motor 3 having its power output delivered to an angle drive 6 having its power output on output spindle 7. Attached to output spindle 7 is a spindle mounting cap 13 having on its peripheral surface a belt drive roller 11 which is essentially a crowned driving roller for the continuous flexible sanding belt 19 (best seen in FIG. 1).

According to the prior art an integral mounting clamp 12 with guard 15 is attached to the angle drive housing by compressive cooperative relationship accomplished by a clamping screw (not shown) which is inserted in guard mounting screw hole 25. Tightening the screw series to reduce the circumference and hence the diameter of the mounting clamp 12 about the angle drive housing 6 to cause a clamping fit and retention of the mounting block and guard on the housing.

A clevis bar 14 is shown mounted to the mounting clamp by means of two mounting and tracking screws 18 and 18'. A tracking pin 21 is provided between the mounting clamp 12 and the clevis bar 14. The pin 21 permits angular displacement between the mounting clamp and the clevis bar as a means of adjusting belt tracking between the belt drive roller 11 and an idler roller 16 mounted on a yoke 17 by means of a pin shaft 26 at the unsupported end of the clevis 14.

Axial extension and therefore belt tension is promoted by a spring 42 which is inserted in an axial bore in the clevis and cooperates between the clevis and the yoke in compression. Tracking of the belt is controlled by selectively orienting the clevis about the tracking pivot pin 21 by means of selecting appropriate draw on tensioning screws 18 and 18'.

In the prior art the mounting clamp 12 and guard 15 were manufactured integrally from a single block of material (either aluminum or steel) by a machine process. The resulting assembly was both expensive to manufacture and added substantial weight to the sanding belt assembly. Since this is intended for handheld operation, the weight of the device is of importance. In addition, although the mounting clamp requires substantial strength to support the forces associated with the grinding operation, it is desirable that the guard be produced from a more flexible impact resisting material which permits some flexure of the guard while preventing its permanent deformation in typical work day applications.

For these reasons the new design allows the mounting flange and the guard to be manufactured of materials more suitable to the individual tasks. For example, with the new design the mounting block may be manufactured of a material, such as aluminum, providing sufficient rigidity, strength, and screw retaining capability with lighter weight. This allows the guard to be manufactured from a spring steel material or resilient structural plastic, thereby allowing an overall lighter weight of the guard. With the added flexibility, the guard has the ability to sustain minor impact without being permanently deformed so as to interfere with sander operation.

The design also permits the combination to be manufactured with significantly less material waste and simpler machining operations. The guard, in fact, may be simply molded or produced from a bent form of resilient material through a simple stamping and bending operation as will be appreciated by on skilled in the art. The improved design for the mounting block is shown in FIGS. 3 and 4 and the improved design for the guard is shown in FIGS. 5 and 6.

Figure 3:
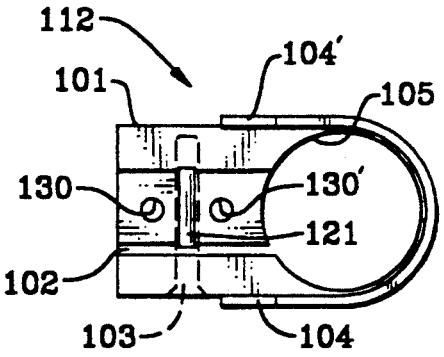
FIG. 3 is a side elevation view as viewed in FIG. 1 of a new mounting block illustrating an embodiment of the belt tensioning device of this invention.
Figure 4:
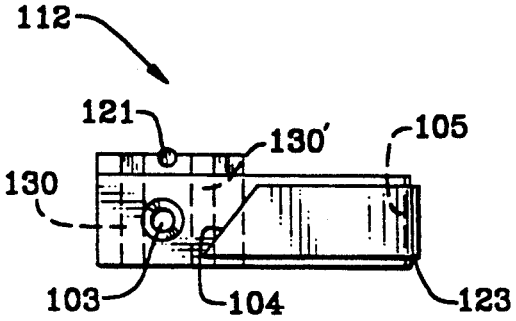
FIG. 4 is a bottom plan view of a new mounting block according to the present invention.

Referring now to FIG. 3, a mounting block 112 according to the present invention is provided having a substantially circular bore 105 provided therethrough to allow the mounting block to be received on the substantially cylindrical outside surface of the angle drive housing 6. A projecting portion 101 of the mounting block is split by a clearance slot 102 which permits the reduction of the circumference and therefore the diameter of the mounting bore 105 when the relief slot 102 is compressed by, for example, a screw inserted in the clamping bore 103 (best seen on FIG. 4). The clamping bore 103 projects through the extension 101 and is threaded in the wider section.

It should be appreciated by one skilled in the art that a clamping screw inserted in the clamping bore 103 will engage the threads in the clamping bore and upon tightening the screw will provide the necessary clamping force to assemble the mounting block to the angle drive housing. The mounting block is further provided with a tracking pivot pin 121 and two threaded bores 130 and 130' for receiving the tracking screws 18, 18', as previously described.

Figure 5:
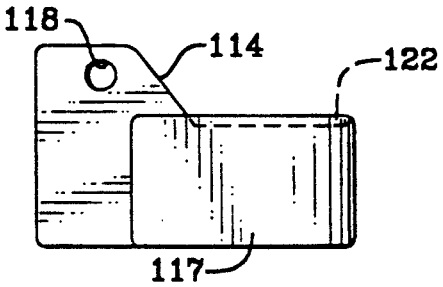
FIG. 5 is a top plan view of a new guard for the present invention.
Figure 6:
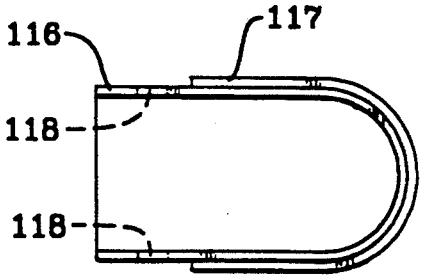
FIG. 6 is a side elevation view as viewed in FIG. 1 of the new guard according to the present invention.

An angle guide surface at 104, 104' is provided to cooperate with the complimentary guide surfaces 114 (shown) and 114' (not shown) as best seen on FIG. 5. In addition, an arcuate guide surface 122 is provided on the guard to cooperate with mounting surface 123 on the mounting block.

FIG. 6 best shows the "U" shaped configuration of the guard generally shown by reference numeral 115 and also shows a composite configuration of the guard according to one preferred embodiment. The guard may be constructed from piece of flexible metal 116 having a composite plastic overlay 117. However, it should be understood that the guard may be constructed from a single piece of flexible steel or a molded plastic or similar material exhibiting the combination of strength and flexibility required.

The guard may be securely mounted to the mounting block by means of the clamping screw through mounting bore 118 or a similar satisfactory mounting means. The combination of overlapping guide surfaces 104, 104' with 114, 114' and 122 with 123 positions and secures the guard to the mounting block.

As may now be appreciated by one skilled in the art the spring 42 provides the tensioning of the sanding belt. We have described a new mounting block and guard means for a new tensioning device that permits for the economy of manufacture of the tensioning device.

Having described the invention, what is claimed is:

1. A mounting and guard device for a belt sander sanding belt engaging and driving means or the like comprising:

a mounting block means for mounting a belt sanding device to a rotary power source;

a guard means attached to said mounting means and at least partially encircling the sanding belt engaging and driving means for limiting user contact with the sanding belt engaging and driving means; and wherein said mounting block means and said guard means are provided with a cooperating arcuate surface and a cooperating diagonal surface for fixing the position of said guard means on said mounting block means.

2. A mounting and guard device according to claim 1, wherein said mounting block means further comprises a substantially rectangular block having a reducible through bore for selectively orienting and mounting a belt sander.

3. A mounting and guard device according to claim 2, wherein said cooperating surfaces are overlapping and abutting surfaces.

4. A mounting and guard device according to claim 1, wherein said guard means is "U" shaped.

5. A mounting and guard device according to claim 4, wherein said guard means is made of a material more flexible and resilient than said mounting block means.

6. A mounting and guard device according to claim 5, wherein said mounting block means is made of metal and said guard means is made of a resilient plastic material.

* * * * *